US007455107B2

(12) United States Patent
Khomynets

(10) Patent No.: US 7,455,107 B2
(45) Date of Patent: Nov. 25, 2008

(54) WELL JET DEVICE FOR LOGGING HORIZONTAL WELLS AND THE OPERATING METHOD THEREOF

(76) Inventor: Zinoviy Dmitrievich Khomynets, d.33, ul. Vilshanetskaya, Tismenitsa, obl.Ivano-Frankovskaya (UA) 77400

( * ) Notice: Subject to any disclaimer, the term of this patent is extended or adjusted under 35 U.S.C. 154(b) by 199 days.

(21) Appl. No.: 10/595,727

(22) PCT Filed: Jun. 12, 2004

(86) PCT No.: PCT/RU2004/000238

§ 371 (c)(1),
(2), (4) Date: May 7, 2006

(87) PCT Pub. No.: WO2005/050028

PCT Pub. Date: Jun. 2, 2005

(65) Prior Publication Data

US 2007/0131430 A1 Jun. 14, 2007

(30) Foreign Application Priority Data

Nov. 20, 2003 (RU) ..... 2003133505

(51) Int. Cl.
*E21B 47/01* (2006.01)

(52) U.S. Cl. ..... 166/250.01; 166/101

(58) Field of Classification Search ..... 166/250.01, 166/370, 385, 387, 66, 106, 381, 386, 68, 166/68.5, 254.3; 417/172
See application file for complete search history.

(56) References Cited

U.S. PATENT DOCUMENTS

| | | | | |
|---|---|---|---|---|
| 2,946,565 | A * | 7/1960 | Williams | 166/264 |
| 4,293,283 | A | 10/1981 | Roeder | |
| 4,744,730 | A | 5/1988 | Roeder | |
| 5,372,190 | A * | 12/1994 | Coleman | 166/68 |
| 6,427,776 | B1 * | 8/2002 | Hoffman et al. | 166/311 |
| 2004/0238164 | A1 * | 12/2004 | Khomynets et al. | 166/250.04 |
| 2007/0081903 | A1 * | 4/2007 | Khomynets | 417/172 |

FOREIGN PATENT DOCUMENTS

| | | |
|---|---|---|
| RU | 2059891 | 5/1996 |
| RU | 2089755 | 9/1997 |
| RU | 2121610 | 11/1998 |

* cited by examiner

*Primary Examiner*—David J. Bagnell
*Assistant Examiner*—David Andrews

(57) ABSTRACT

In pumping engineering, the inventive device comprises a ring provided with a sealing unit arranged on a casing string and smooth pipe column. The pump body has a channel supplying an active medium, a channel supplying an active medium pumped out of the well and a stepped through channel such that it is possible to mount therein a blocking insert which closes the active medium supply channel or a depression insert whose mounting cuts off the cross section of the pipe column. A logging device is arranged on the lower end of the pipe column, a sealing unit is put on said pipe column between said logging device and the jet pump such that it is axially offsetable with respect to the pipe column, the lower section of the pipe column above the logging device is embodied such that is perforated.

4 Claims, 2 Drawing Sheets

WELL JET DEVICE FOR LOGGING HORIZONTAL WELLS AND THE OPERATING METHOD THEREOF

FIELD OF THE INVENTION

The present invention relates to the field of pumping engineering, particularly to well jet devices for extracting oil from wells.

PRIOR ART

A well jet device is known, which comprises a jet pump arranged on a tubing string in a well and a well parameter measuring device arranged below the said jet pump (RU 2089755 C1).

The same source discloses a method of operating the said well jet device, which comprises lowering a tubing string together with a jet pump, a sealing unit and a well parameter measuring device on a logging cable into a well, placing the said measuring device in front of a production formation, and measuring parameters of the latter.

The said device and the method of operating thereof enable to carry out well studies and, due to it, intensify works on studying near-borehole areas in formations.

They, however, do not enable to carry out works on treating the near-borehole area in a formation, which lowers their possibilities.

The closest to this invention as to the technical essence and the achieved result in the part of the device is a well jet device comprising, all of them being arranged on a tubing string, a packer with an axial channel and a jet pump having an active nozzle, a mixing chamber and a through channel having a mounting seat for installing a sealing unit with an axial channel, a transmitter and a receiver-transducer of physical fields arranged in the under-packer area on the jet pump side for entry of the medium pumped out of the well, the said receiver-transducer being installed on a logging cable passed through the said axial channel of the said sealing unit, the output side of the jet pump being connected to the space surrounding the tubing string, the jet pump channel side for entry of the pumped out medium being connected to the inner cavity of the tubing string below the sealing unit, and the input side of the channel for supplying the working medium to the said active nozzle being connected to the inner cavity of the tubing string above the sealing unit (RU 2121610 C1).

The same patent discloses a method of operating a well jet device, which comprises arrangement on the tubing string of a jet pump with a through channel and a packer, lowering of the whole assembly into a well, release of the packer and creation of a necessary depression in the under-packer area by pumping a liquid medium out of the under-packer area with the use of the said jet pump.

The known well jet device and the operating method thereof enable to carry out various process operations in a well below the level at which the jet pump is arranged, including those consisting in reducing a pressure differential above and below the sealing unit.

But, the cited device does not enable to utilize its capabilities in full, since it enables to study producing rocks only in boreholes close to vertical, which narrows the field of using that operating method and that well jet device for realizing it. Furthermore, a rearrangement of the jet pump is a rather labor-consuming operation requiring release of the packer for its subsequent installation in a new place, which increases the time necessary for carrying out a full-value study.

SUMMARY OF THE INVENTION

The task to be solved by this invention is to intensify works on studying, testing and completing wells, primarily horizontal wells having a great curvature.

The stated task in the part of the device is solved owing to the fact that a well jet device for logging horizontal wells comprises a ring, which is arranged on the lower section of a casing string, with a stepped through channel intended for installing a sealing unit, a smooth tubing string with a jet pump installed on it, in the body of the said jet pump an active nozzle and a mixing chamber with a diffuser are arranged as well as a channel for supplying an active medium, a channel for supplying a medium pumped out of a well and a stepped through channel are made, the latter channel being embodied in such a way that it is possible to install therein either a blocking insert having a through channel and serving for closing the channel for supplying an active medium or a depression insert which, when installed, closes the tubing string in its cross-section, a logging device is arranged on the lower end of the tubing string, a sealing unit is put on the tubing string between the logging device and the jet pump in such a way that the sealing unit may be axially moved relative to the tubing string, and the lower section of the tubing string above the logging device is made perforated.

The stated task in the part of the method is solved owing to the fact that the method of operating a well jet device for logging horizontal wells consists in installing the ring with the stepped through channel into the lower section of the casing string, then the jet pump with the stepped through channel made in its body and the logging device installed on the lower end of the tubing string and arranged below the jet pump are lowered into the well on the smooth tubing string, the perforated section is made in the lower end of the tubing string, and the sealing unit, movable relative to the tubing string, is preliminarily put on the tubing string between the logging device and the jet pump, background values of the production formation physical parameters are registered with the use of the logging device in the process of lowering, then the sealing unit is arranged in the stepped through channel made in the ring, and the logging device is arranged in the area of production formations, afterwards a depression insert is installed into the stepped through channel made in the body of the jet pump, thus separating the tubing string, and an operating medium is fed over the tubing string to the nozzle of the jet pump, thus creating a series of different-value depressions in the well below the sealing unit, at each depression value the well flow rate is measured and the bottom-hole pressure is registered, then, when the jet pump is in operation, the logging device is moved along production formations by moving the tubing string together with the jet pump relative to the sealing unit, and the geophysical parameters of production formations and the formation fluid coming into the well are registered; when the study is completed the tubing string is raised to the surface together with the jet pump, the sealing unit and the logging device.

The stated task in the part of the method is also solved owing to the fact that after registration of the geophysical parameters of the production formations and the formation fluid coming into the well additional measurements of the geophysical parameters may be made when the jet pump is stopped, or an additional study of production formations may be carried out, for which purpose chemical agents are pumped into the well over the tubing string through its lower perforated section, and a chemical treatment of the near-borehole area in the production formations is carried out, in such a case the depression insert is removed from the stepped through channel made in the body of the jet pump and substituted by a blocking insert with the axial through channel.

An analysis of the well jet device operation shows that the operational reliability may be improved both by optimizing the sequence of actions carried out during testing and completing wells, first of all with open or curvilinear boreholes and by simplifying the design of the device for which a packer is excluded from the design and the logging device is arranged on the tubing string without using the logging cable.

It has been found that the above sequence of actions enables most efficiently use the equipment, which is arranged on the tubing string, during works on studying and testing production formations in rocks by forming conditions for obtaining full and reliable information on the condition of the production formations. By creating a series of different-value depressions the jet pump forms in a well the given values of pressure differential, and the well is studied and tested with the use of the logging device. Simultaneously, it is possible to control depression values by controlling the pumping rate of the operating fluid. By carrying out formation testing it is possible to adjust the pumping-out mode by changing the pressure of the operating fluid fed into the nozzle of the jet pump. The arrangement of the logging device on the tubing string with the possibility of axial movement and without using a packer (the sealing unit put on the tubing string is used instead of a packer) enables to carry out better work on testing a well and preparing it for operation and, as a consequence, make the process of testing and completing a well quicker and simpler. Furthermore, the arrangement of the logging device on the tubing string gives the possibility, due to the tubing string elastic properties, of arranging the logging device in the area of production formations in horizontal sections of wells, which enables to obtain reliable information on the condition of production formations, a formation fluid inflow and its properties quicker. As a result, this operation regime enables to carry out quality studies and tests of wells after drilling as well as preparation of wells for operation on the basis of a comprehensive study and its testing in different regimes.

Thus, the above totality of the interdependent sequence of actions and the above-stated design features of the well jet device ensures the fulfillment of the task stated for the invention, namely, to intensify works on studying and testing wells, primarily horizontal wells and those of great curvature, as well as to improve the operational reliability of the well jet device.

DESCRIPTION OF THE PREFERRED EMBODIMENT

Figure 1:
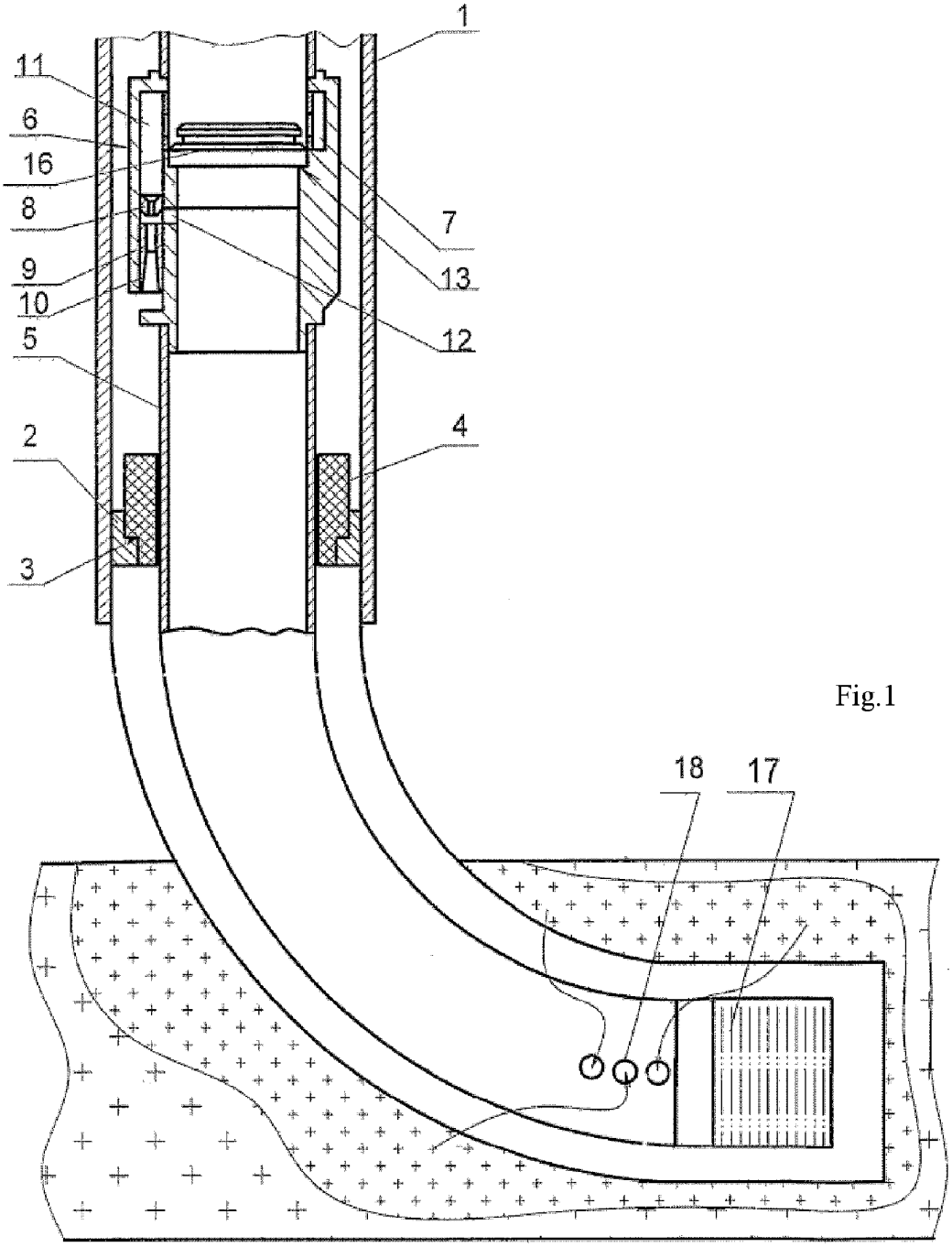
FIG. 1 shows a lengthwise section of the claimed device with a depression insert.
Figure 2:
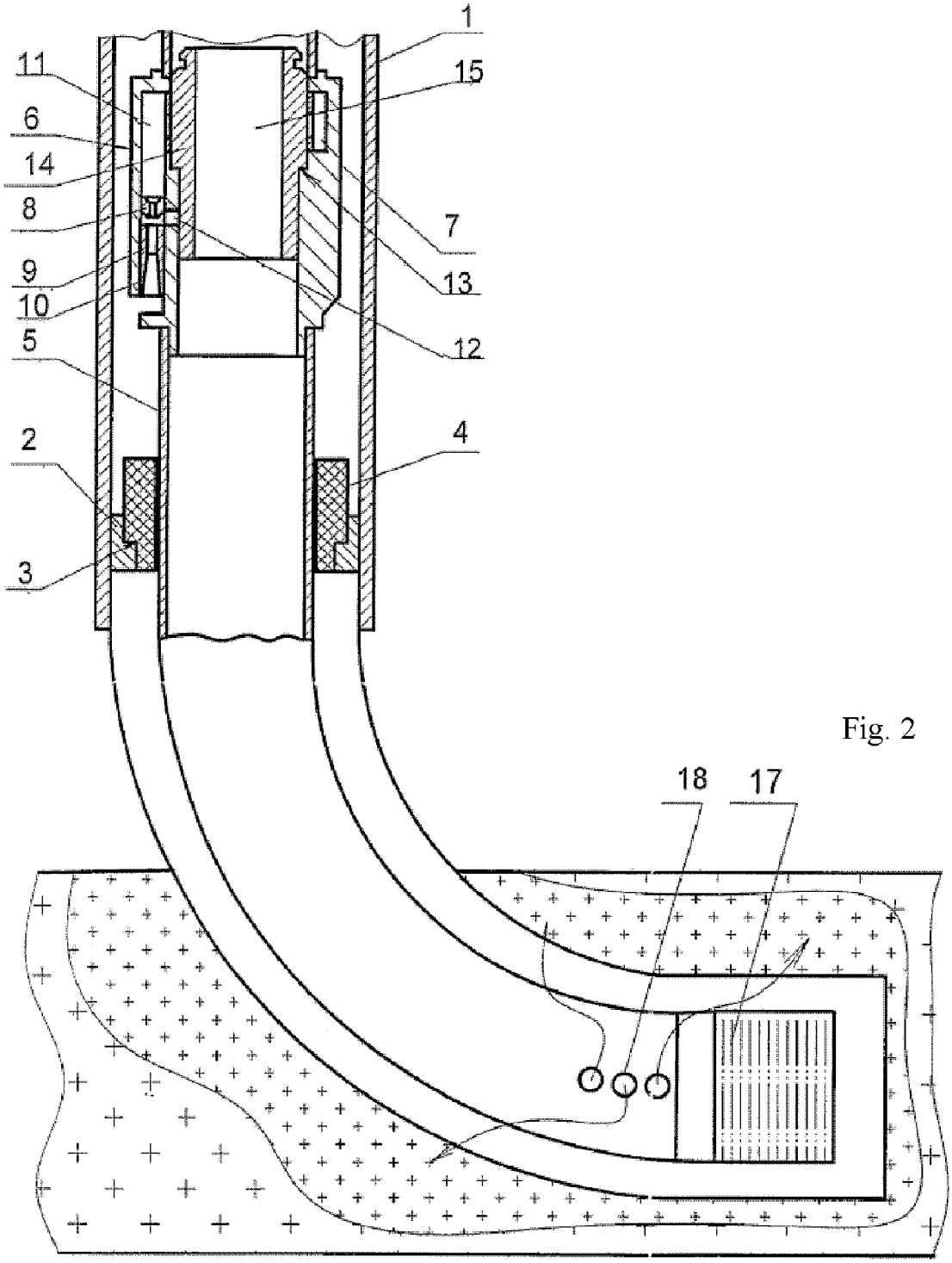
FIG. 2 shows a lengthwise section of the claimed device with a blocking insert.

The claimed device used for carrying out the claimed method comprises the ring 2, which is arranged on the lower section of the casing string 1, with the stepped through channel 3 intended for installing the sealing unit 4, the smooth tubing string 5 with the jet pump 6 installed on it, in the body 7 of the said jet pump the active nozzle 8 and the mixing chamber 9 with a diffuser 10 are arranged as well as the channel 11 for supplying an active medium, the channel 12 for supplying a medium pumped out of a well and the stepped through channel 13 are made, the latter channel being embodied in such a way that it is possible to install therein either a blocking insert 14 having the through channel 15 and serving for closing the channel 11 for supplying an active medium or the depression insert 16 which, when installed, closes the tubing string 5 in its cross-section. The logging device 17 is arranged on the lower end of the tubing string 5, the sealing unit 4 is put on the tubing string 5 between the logging device 17 and the jet pump 6 in such a way that the sealing unit may be axially moved relative to the tubing string 5, and the lower section of the tubing string 5 above the logging device is made perforated, namely, holes 18 are made in the tubing string 5.

The claimed method of operating the well jet device is carried out as follows.

The ring 2 with the stepped through channel 3 is installed into the lower section of the casing string 1. Then the jet pump 6 with the stepped through channel 13 made in its body 7 and the logging device 17 arranged below the jet pump 6 are lowered into the well on the smooth tubing string 5. The sealing unit 4, movable relative to the tubing string 5, is preliminarily put on the tubing string 5 between the logging device 17 and the jet pump 6. Background values of the production formation physical parameters are registered with the use of the logging device 17 in the process of lowering. Then the sealing unit 4 is arranged in the stepped through channel 3 made in the ring 2, and the logging device 17 is arranged in the area of production formations. Afterwards the depression insert 16 is installed into the stepped through channel 13 made in the body 7 of the jet pump 6, thus separating the tubing string 5, and an operating medium is fed over the tubing string 5 to the nozzle 8 of the jet pump 6, thus creating a series of different-value depressions in the well below the sealing unit 4. At each depression value the well flow rate is measured and the bottom-hole pressure is registered. Then, when the jet pump is in operation, the logging device 17 is moved along production formations by moving the tubing string 5 together with the jet pump 6 relative to the sealing unit 4, and the geophysical parameters of production formations and the formation fluid coming into the well are registered. When the study is completed the tubing string 5 is raised to the surface together with the jet pump 6, the sealing unit 4 and the logging device 17.

After registration of the geophysical parameters of the production formations and the formation fluid coming into the well additional measurements of the geophysical parameters may be made when the jet pump 6 is stopped.

Also, after registration of the geophysical parameters of the production formations and the formation fluid coming into the well an additional study of production formations may be carried out, for which purpose chemical agents are pumped into the well over the tubing string 5 through the holes 18 in its lower perforated section, and a chemical treatment of the near-borehole area in the production formations is carried out, in such a case the depression insert 16 is removed from the stepped through channel 13 made in the body 7 of the jet pump 6 and substituted by a blocking insert 14 with the axial through channel 15.

INDUSTRIAL APPLICABILITY

The present invention may be used in the oil industry for testing and completing wells as well as in other industries where various fluids are extracted from wells.

The invention claimed is:

1. A well jet device for logging horizontal wells comprising a ring, arranged on a lower section of a casing string, with a stepped through channel for installing a sealing unit, a smooth tubing string with a jet pump installed thereon, in the body of the said jet pump an active nozzle and a mixing chamber with a diffuser are arranged as well as a channel for supplying an active medium, a channel for supplying a medium pumped out of a well and a stepped through channel are made, the latter channel having install therein either a blocking insert having a through channel and serving for closing the channel for supplying an active medium or a depression insert which, when installed, closes the tubing string in its cross-section, a logging device is arranged on the lower end of the tubing string, a sealing unit is put on the tubing string between the logging device and the jet pump such that the sealing unit is axially movable relative to the tubing string, and the lower section of the tubing string above the logging device is perforated.

2. A method of operating a well jet device for logging horizontal wells consisting in installing the ring with the stepped through channel into the lower section of the casing string, then installing a jet pump with a stepped through channel made in its body and installing the logging device on the lower end of the tubing string arranged below the jet pump an lowering the well jet device into the well on a smooth tubing string, making a perforated section in the lower end of the tubing string, and preliminarlily putting the sealing unit, which is movable relative to the tubing string, on the tubing string between the logging device and the jet pump, registering background values of the production formation physical parameters with the use of the logging device in the process of lowering, then arranging the sealing unit in the stepped through channel made in the ring, and arranging the logging device in the area of production formations, afterwards installing a depression insert into the stepped through channel made in the body of the jet pump, thus separating the tubing string, and feeding an operating medium over the tubing string to the nozzle of the jet pump, thus creating a series of different-value pressure depressed zones in the well below the sealing unit, measuring the well flow rate at each depression value and registering the bottom-hole pressure, then, when the jet pump is in operation, moving the logging device along production formations by moving the tubing string together with the jet pump relative to the sealing unit, and registering the geophysical parameters of production formations and the formation fluid coming into the well; when the study is completed, raising the tubing string to the surface together with the jet pump, the sealing unit and the logging device.

3. The method of operating according to claim 2, characterized in that after registration of the geophysical parameters of the production formations and the formation fluid coming into the well, making additional measurements of the geophysical parameters when the jet pump is stopped.

4. The method of operating according to claim 2, characterized in that after registration of the geophysical parameters of the production formations and the formation fluid coming into the well, carrying out an additional study of production formations, for which purpose chemical agents are pumped into the well over the tubing string through its lower perforated section, and carrying out a chemical treatment of the near-borehole area in the production formations is, in such a case, removing the depression insert from the stepped through channel made in the body of the jet pump and substituting a blocking insert with the axial through channel.

* * * * *